US005560682A

United States Patent [19]

Brown

[11] Patent Number: 5,560,682

[45] Date of Patent: Oct. 1, 1996

[54] ADJUSTMENT MECHANISM FOR A CHAIR

[75] Inventor: Justin P. Brown, Dudley Park, Australia

[73] Assignee: Klasse Pty Ltd, Dudley Park, Australia

[21] Appl. No.: 160,101

[22] Filed: Nov. 30, 1993

[30] Foreign Application Priority Data

Dec. 1, 1992 [AU] Australia ..... PL6101

[51] Int. Cl.[6] ..... B60N 2/02

[52] U.S. Cl. ..... 297/374; 297/316

[58] Field of Search ..... 297/374, 316, 297/320, 300, 301, 298, 340

[56] References Cited

U.S. PATENT DOCUMENTS

| | | | |
|---|---|---|---|
| 2,471,024 | 5/1949 | Cramer | 297/301 |
| 4,629,249 | 12/1986 | Yamaguchi | 297/316 X |
| 4,693,514 | 9/1987 | Volkle | 297/374 |
| 4,717,194 | 1/1988 | Ota et al. | 297/340 X |
| 5,066,069 | 11/1991 | De Gelder | 297/374 |
| 5,348,371 | 9/1994 | Miotto | 297/301 |
| 5,356,200 | 10/1994 | Stumpf et al. | 297/374 X |

*Primary Examiner*—Laurie K. Cranmer

*Attorney, Agent, or Firm*—Knobbe, Martens, Olson & Bear

[57] ABSTRACT

An adjustment mechanism for a chair that adjusts the angle of inclination of both the seat and back portions simultaneously to adopt the best relative ergonomic positions. The adjustment mechanism comprises a mounting means for connection to a chair support column and a first frame member for supporting the seat portion that is pivotally mounted to the mounting means. A second frame member for supporting the back portion of a chair is pivotally mounted to the first frame member. A control member is pivotally mounted at a first end to the second frame member, and has a slot that engages a bar that is fixed to the first frame member. Locking means associated with the bar releasably locks the control member with respect to the bar. A link is pivotally attached at one end to the second end of the control member and is pivotally attached at the other end to the mounting means. The control member is held by the link so that the angle of the slot to the horizontal is maintained. The angle of the slot is such that when the locking means is released, either tilting movement of the seat portion causes the bar to force the movement of the control member with respect to the bar, or tilting of the back portion causes an upward or downward force to be applied to the bar. In either case, the back and seat portions move simultaneously.

9 Claims, 2 Drawing Sheets

ADJUSTMENT MECHANISM FOR A CHAIR

Figure 1:
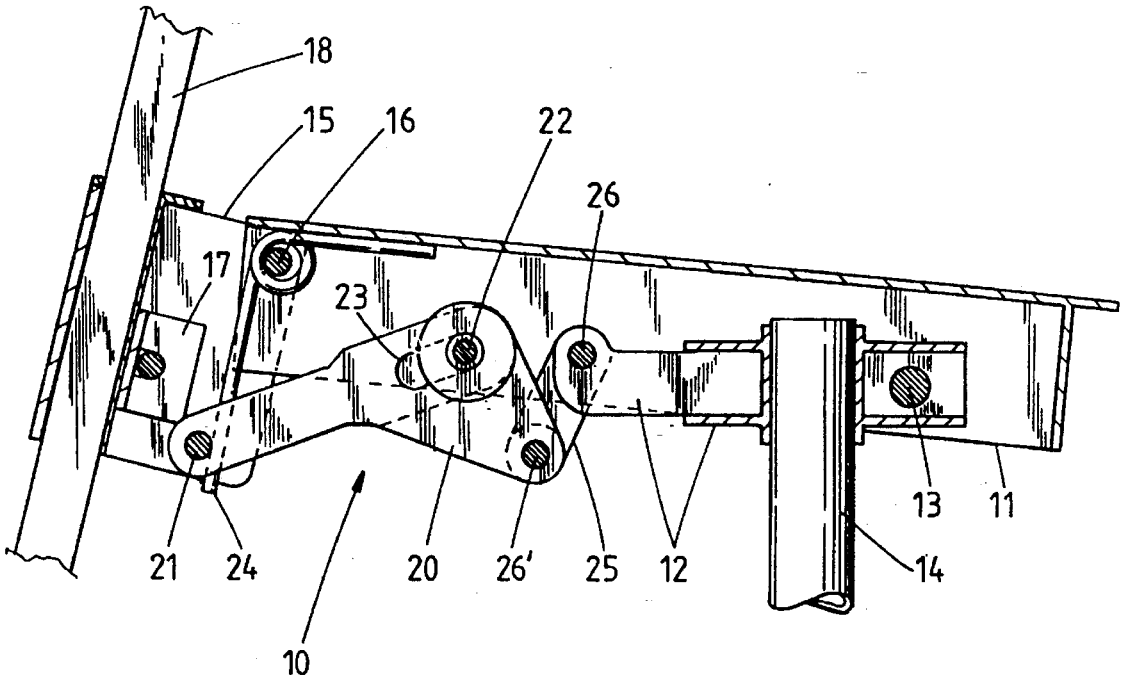

This invention relates to an adjustment mechanism for a chair, and in particular to an adjustment mechanism where the movement of the seat and back portions of the chair are linked such that adjustment of either the seat or back portion will determine the position of the back portion with respect to the seat portion.

In relation to the chairs, and particularly in relation to chairs commonly used in office situations, there has been a great deal of development in various constructions in which enable the inclination of the seating portions to be adjusted so as to allow comfortable and anatomically correct seating positions. Such seats provide a number of adjustment of the seat portion, height adjustment of the back portion, and adjustment of inclination of both the seat and back portions.

A large number of adjustment mechanisms, particularly for adjusting the inclination of the seat and portion, are available. Normally, such adjustment mechanisms allow for independent movement of both the seat and back portion. Some mechanisms use individual levers, one for each adjustment required, whereas some mechanism have a single adjustment lever which allows independent inclination of both the back and seat portion.

One problem with such mechanisms is that although it is convenient to use only one single adjustment lever, it is sometimes difficult to place the seat and back portions in exactly the desired position. Normally, such adjustment is done while sitting in the seat, and therefore it is necessary to be able to independently control the position of both the seat and back portion to the required position while holding the release lever. This is often difficult to achieve, and will also result in relative positions of the seat and back portions being attained which are ergonomically incorrect.

Often, the adjustability of the back and seat portions is required as a result of the person undertaking a variety of tasks. This is particularly so in relation to computer work stations where a person may be operating a computer keyboard where the level of the keyboard is at a lower level by comparison to a general work surface. Therefore, for the chair to be adaptable to both keyboard operation and the general work surface, then there is a requirement for the seat and back portion to be adjusted to specific positions in relation to one another. Such relative orientations are the optimum positions in relation to the various tasks being performed.

Therefore, it is an object of this invention to provide an adjustment mechanism for a chair which overcomes the abovementioned problems, and in particular which provides an adjustment mechanism which will adjust the seat and back portions of a chair into specific positions relative to one another.

In addition to providing the required range of movement, it is necessary that the chair be simple and easy to operate. Apart from conventional height and attitude adjustment mechanisms, it is important that the invention provide a means whereby the occupant of the seat is able to effect all adjustment movements of the seat while actually seated. For example, when adjusting the backrest, upon leaning forward, the mechanism should be arranged such that under the action of a spring, the backrest moves of its own accord. Adjustment in the opposite direction may then be achieved by leaning back against the seat portion. Therefore, it is a further objection of the invention to provide a means of readily adjusting the seat while the occupant remains seated.

In its broadest form, an adjustment mechanism for a chair that simultaneously adjusts the angle of inclination of both the seat and back portions of said chair comprising, a mounting means for connection to said chair support column, a first frame member for supporting said seat portion pivotally mounted to said mounting means, a second frame member for supporting said back portion, said second frame member pivotally mounted to said first frame member, a control member pivotally mounted at a first end to said second frame member and having a slot therein, a bar fixed to said first frame member extending through said slot of said control member, locking means associated with said bar which releasably locks said control member with respect to said bar, and support means for holding the second end of said control member with respect to said mounting means, said control member being held such that its second end can move in a substantially horizontal plane, but can not move in a vertical plane and said slot being angled with respect to a horizontal plane such that, when said locking means is released, either tilting movement of said seat portion causes said bar to force movement of said control member along its longitudinal axis, or tilting movement of said back portion causes an upward or downward force to be applied to said bar, such that, in either case, said back and seat portions move simultaneously.

Preferably, the geometry of the various components is such that the angle of inclination of the back portion will ergonomically match the angle of inclination of the seat portion, and that this matching or synchronisation of movements will occur throughout the entire range of rotation of the seat and back portions. This means that when the back portion is rotated to its most forward or more rearward position, or in any position in between, then the angle that the seat portion takes with respect to any given seat angle, will be ergonomically the most correct. Further, adjustments may also be achieved by movement of the seat portion, although the required mechanical advantage is best achieved through operation of the back portion.

Obviously, the relative positions of the seat portion with respect to the back portion will depend upon the precise geometry of the various elements, and can be obviously adjusted to suit the requirements of the user.

As mentioned above, the support means holds the second end of the control members such that it is able to move in a particular manner. The portion of the second end of the control member which is supported by the support means is constrained such that the support means is able to move along its longitudinal axis but that the second end of the support means is constrained such that it is not able to move substantially within a vertical plan. This may be achieved in a number of means, but preferably the support means comprises a link the first end of the link being pivotally attached to the mounting means, the second end of the link being pivotally attached to the second end of the control means. In this manner, the second end of the control means is maintained at a substantially constant height through its range of movements, while still allowing the control member to move along its longitudinal axis. Of course such movement will result in pivoting of the control member about its second end, which of course will affect rotational movement of the second frame member about its pivotal attachment to the first frame member.

In this arrangement, with the slot angled to a horizontal plane, the bar that locates through the slot in a control member can be used either to act against the control member to affect movement of the second frame member, or the control member can act against the bar to affect movement of the first frame member. Preferably, the forward end of the slot which is closest to the front edge of the seat portion is higher than the other end of the slot. In this arrangement, when the seat portion is tilted either forward or rearward, the bar either pushes upwardly or downwardly against the slot. As a result of the angled nature of the slot, the bar transfers a force which causes movement of the control member along its longitudinal axis thereby causing rotation of the second frame member in the required direction. Preferably though, when the back portion is tilted, then the control member acts against the bar to in turn cause the required tilting of the seat portion.

In addition to the use of a link, the support means may also comprise a plate upon which the second end of the control member locates. The second end of the control member may slidably engage the plate, or there may in fact be provided a roller bearing to enable smooth movement of the control means with respect to the plate.

Preferably, the locking means associated with the bar comprises a plurality of plates and lock washers in combination with a spring-loaded clamp. The clamp comprises a clamp plate on the bar and located on one side of the control member. A spring provides compressive force to the clamping plate so that it bears against the control member compressing the clamp plates and washers thereby holding the control member with respect to the bar.

The bar is conveniently provided with a lever mechanism arranged to release the clamping pressure thereby allowing the control member to move with respect to the bar which allows relative movement of the various components.

In order to fully understand the invention, a preferred embodiment will now be described, however it should be realised that the scope of the invention is not to be confined or restricted to the precise details of this embodiment.

Figure 2:
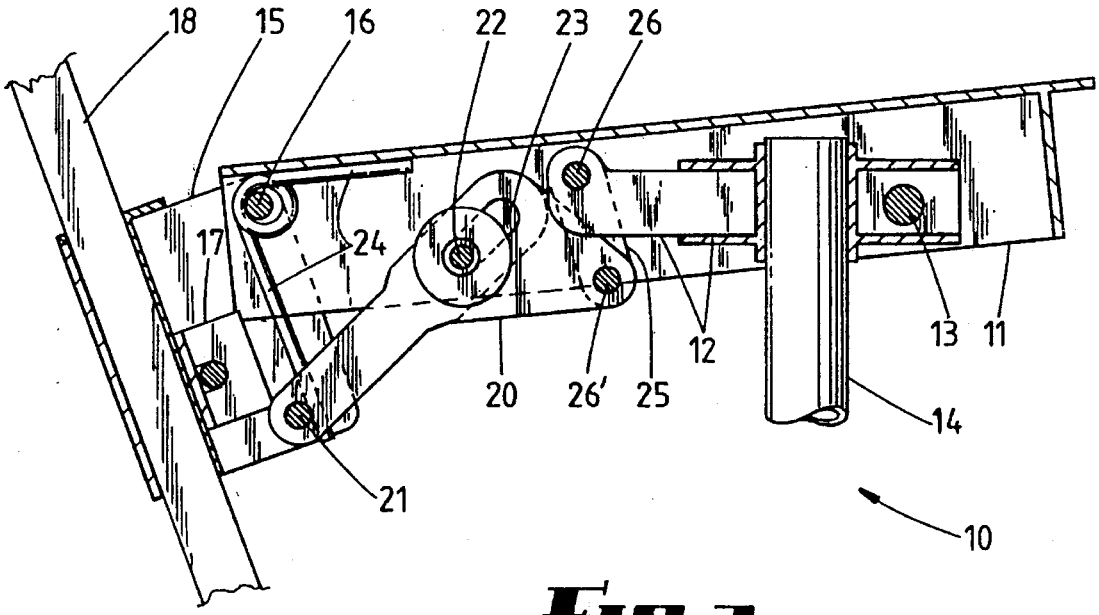
Figure 3:
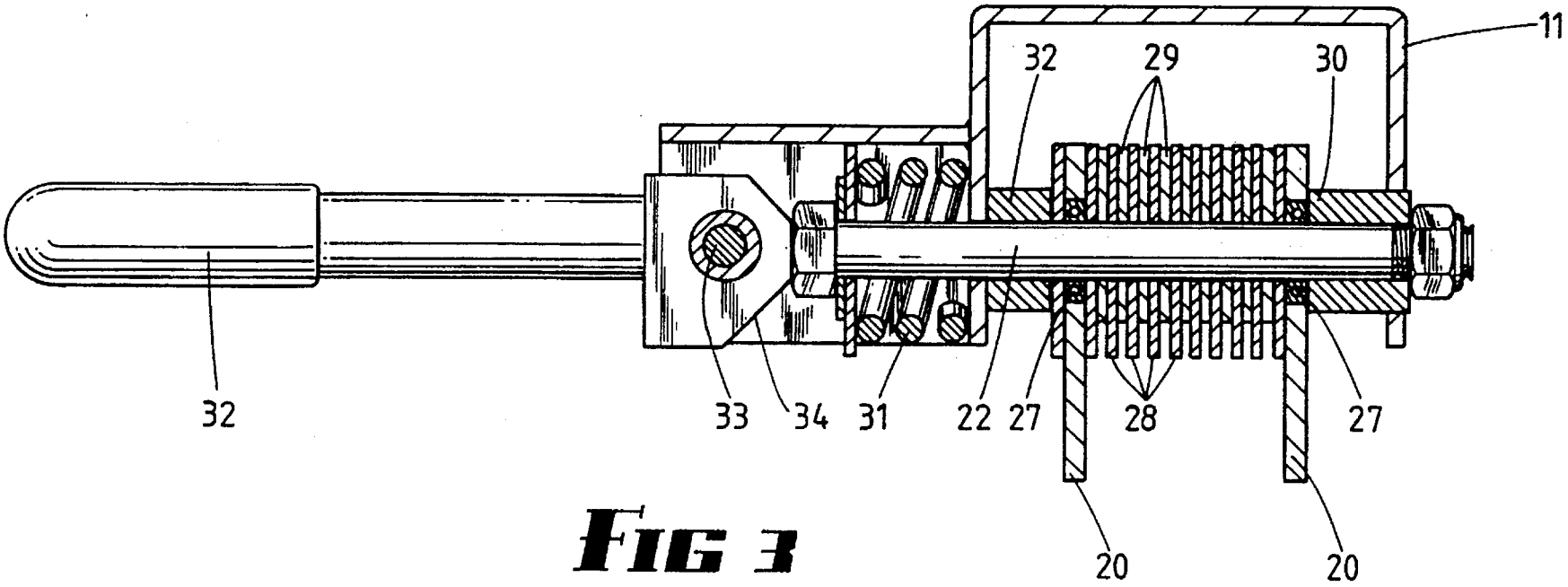

This embodiment is illustrated in the accompanying diagrams in which;

FIG. 1 shows a side view of said adjustment mechanism with the back portion in its forwarding position, FIG. 2 shows a side view of said adjustment mechanism with the back portion in its rear position, and FIG. 3 shows a cross-sectional view through the locking mechanism.

In this embodiment, the adjustment mechanism 10 as illustrated in the accompanying drawings shows only the basic components of the adjustment mechanism 10, and does not show in detail other components such as the seat or back portions and only part of the backrest column and the support column of the chair. The first frame member comprises a channel 11 which is secured to the base of a seat portion. The mounting means 12 is pivotally mounted to the channel 11 via an horizontal shaft 13. The mounting means 12 is provided with a cylindrical recess, within which the upper end of the central support column locates. Normally, the central support column 14 comprises a pneumatic cylinder, which is of adjustable length, and therefore the mounting means 12 also carries a lever capable of operating the pneumatic cylinder to enable inflation and deflation of the cylinder.

The second frame member comprises a channel-shaped bracket 15 which is pivotally attached to the rear end of channel 11 via an horizontal shaft 16. The bracket 15 is arranged to support the back portion, and so there is provided a clamp plate 17. The post 18 supporting the back portion locates between the clamp plate 17 and the end of the bracket 15, and an eccentric locking cam is used to lock the back portion support in place.

The movement of the seat portion with respect to the back portion is controlled by the control member 20. The control member 20 is pivotally attached to the bracket 15 by a horizontal shaft 21. The movement of the control member 20 with respect to the channel 11 is controlled by a bar 22 which locates within slot 23. A roller bearing 27 is located on the bar 22 such that the outer race is within the slot 23. Sufficient clearance is provided between the sides of the slot 23 and the outer race such that it bears against only one side of the slot 23. This allows smoother movement of the control member 20 with respect to the bar 23. Tilting of either the seat portion or the backrest portion will cause either rotation of the channel 11 about shaft 13, which in turn will cause the control member 20 to be moved and to effect rotation of the bracket 15 about shaft 16, or in turn if the backrest is tilted, then it will cause rotation of the bracket 15 about the shaft 16, which will in turn cause movement of the control member 20, which will in turn act upon the bar 22 which will cause rotation of the channel 11 about shaft 13. The slot 23 is angled with respect to the horizontal plane such that the forward end of the slot 23 which is closest to the forward edge of the seat portion is higher than the other end of the slot 23. As the second end of the control member 20 which is connected pivotal to the link member 25 is held such that it remains substantially in the same horizontal plane, tilting movement of either the channel 11 or bracket 15 will cause the bar 22 to act against the slot 23, or the slot 23 to act against the bar 22 respectively. This in turn causes simultaneous movement of the seat and backrest portions.

In this embodiment, the control member 20 comprises a pair of metal plates, and this is best illustrated in FIG. 3.

Associated with the bar 22 is a locking means 27 which comprises a plurality of locking plates 28 which are located between the two control members 20. Each of the locking plates 28 are pivotally mounted to the horizontal shaft 21, and each have a slot through which the bar 22 locates. In addition the locking plates 28 are spaced by washers 29 which are located on the bar 22 between each locking plate 28.

The bar 22 has on one side a shoulder 30 which bears against the outer surface of a control plate 20, and on the other side a spring 31 which pulls the bar 22 and the associated assembly towards one side of the channel 11. A clamp plate comprising series of washers 32 are positioned between the control plate 20 and the side of the channel 11 which results in the control members 20 and locking plates 28 being fixed with respect to the bar 22. The locking means 27 is released by tilting handle 32 that pivots about shaft 33, which causes the cam 34 to compress the spring 31 and move bar 22 so that shoulder 30 releases the control members 20.

In this embodiment, a spring 24 is located around the horizontal shaft 16, and has arms which contact the channel 11 and horizontal shaft 21 which applies a force to the bracket 15 so as to urge it in a clockwise direction. This movement is restrained by control member 20 when they are locked with respect to the bar 22.

The second ends of the control members 20 are connected to the mounting means 12 via a pair of links 25 and two horizontal shafts 26 and 26', it should be remembered when viewing the diagram, that the mounting means 12 is fixed with respect to the support column 14 of the chair. Therefore, the second end of the control members 20 are effectively prevented from any substantial vertical movement with respect to the mounting means 12, but the control members 20 are able to move along their longitudinal axis with respect to the bar 22 such that rotation of the bracket 15 is affected, while at the same time, as the slot 23 is angled with respect to the horizontal, the slot 23 can act on the bar 22, or vice versa, so as to affect simultaneous movement of both the channel 11 with respect to the mounting means 12, and the bracket 15 with respect to channel 11.

Therefore, in use, and upon release of the locking means 27 associated with the bar 22, the inclination of the seat and back portions can be adjusted, but due to the connection between the bracket 15 and the channel 11, the movement of these two components will be dependent on the geometry of the control members 20 and its linkage to the mounting means 12. The relative movement between the back and seat portions can be changed by altering the dimensions of these components. Accordingly, through the entire range of inclination of the back portion, the inclination of the seat portion can be adjusted such that it is most ergonomically suited to the given position of the back portion.

As will be seen from the above description, the invention provides a novel and unique adjustment mechanism which provides an alternative to chairs having independently adjustable back and seat portions. An adjustment mechanism according to this invention will ensure that the relative positioning of the back and seat portions throughout the range of movement will be matched to provide the most ergonomic and comfortable conditions.

I claim:

1. An adjustment mechanism for a chair having a seat and back portion that simultaneously adjusts the angle of inclination of both said seat and back portions of said chair comprising, a mounting means for connection to a chair support column, a first frame member for supporting said seat portion pivotally mounted to said mounting means, a second frame member for supporting said back portion, said second frame member pivotally mounted to said first frame member, a control member pivotally mounted at a first end to said second frame member and having a slot therein positioned so that the longitudinal axis of said slot is at an angle with respect to a horizontal plane, a bar fixed to said first frame member extending through said slot of said control member, locking means associated with said bar which releasably locks said control member with respect to said bar, and a link, having first and second ends, pivotally attached at said second end to the second end of said control member and pivotally attached at said first end to said mounting means so that when said locking means is released, tilting movement of either said seat or back portions causes movement of said control member with respect to said bar which results in said back and seat portions tilting simultaneously, said link ensuring that said slot remains at an angle with respect to a horizontal plane during the movement of said control member.

2. An adjustment mechanism according to claim 1 wherein forward movement of said back portion causes said seat portion to tilt forward, and rearward movement of said back portion causes said seat portion to tilt rearward.

3. An adjustment mechanism according to claim 2 further comprising spring means acting between said first and second frame members which acts to cause said second frame to rotate with respect to said first frame member, when said locking means is released, so that said second frame member may, if unrestrained, rotate in a clockwise direction.

4. An adjustment mechanism according to claim 1 wherein said chair support column attaches to said mounting means between the pivot connection to said first frame member and the pivot connection to said link.

5. An adjustment mechanism according to claim 4 wherein said slot is angled such that the end of said slot closest to said mounting means is higher than the other end of said slot.

6. An adjustment mechanism according to claim 5 wherein said control member is fabricated from metal plate.

7. An adjustment mechanism according to claim 6 wherein said control member and link each comprise a pair of spaced and parallel plate-like elements.

8. An adjustment mechanism according to claim 7 wherein said locking means comprises a spring actuated clamp that clamps against said control member.

9. An adjustment mechanism according to claim 7 wherein a pair of roller bearings are secured to said bar such that the outer race of each roller bearing locate within a respective slot of said control member.

* * * * *